US010239219B2

(12) United States Patent
Weiner

(10) Patent No.: US 10,239,219 B2
(45) Date of Patent: Mar. 26, 2019

(54) CHILD PROOF KNIFE GUARD

(71) Applicant: Mendel Weiner, Brooklyn, NY (US)

(72) Inventor: Mendel Weiner, Brooklyn, NY (US)

( * ) Notice: Subject to any disclaimer, the term of this patent is extended or adjusted under 35 U.S.C. 154(b) by 0 days.

(21) Appl. No.: 15/613,827

(22) Filed: Jun. 5, 2017

(65) Prior Publication Data

US 2018/0345515 A1 Dec. 6, 2018

(51) Int. Cl.

| | |
|---|---|
| ***B26B 29/02*** | (2006.01) |
| ***B65D 25/02*** | (2006.01) |
| ***B65D 50/00*** | (2006.01) |
| ***B65D 43/22*** | (2006.01) |

(52) U.S. Cl.

CPC ..... *B26B 29/025* (2013.01); *B65D 25/02* (2013.01); *B65D 43/22* (2013.01); *B65D 50/00* (2013.01)

(58) Field of Classification Search

CPC ... A45F 5/02; A45F 5/021; A45F 5/14; B26B 3/06; B26B 29/02; B26B 29/025; B65D 25/00; B65D 25/02; B65D 43/22; B65D 50/00; B65D 85/00; B65D 25/10

USPC ..... 224/232

See application file for complete search history.

(56) References Cited

U.S. PATENT DOCUMENTS 2,618,057 A * 11/1952 Gibson ..... B26B 29/025 224/232
2,763,536 A * 9/1956 Easley ..... C23F 1/42 216/108
3,958,330 A * 5/1976 Hutchens ..... B26B 29/025 224/232
4,404,747 A * 9/1983 Collins ..... B26B 29/025 224/232
4,524,892 A * 6/1985 Ozeki ..... A45F 5/02 224/232
4,961,523 A * 10/1990 Stimac ..... B26B 29/025 224/232
5,155,911 A * 10/1992 Collins ..... B26B 3/06 224/232
6,371,312 B1 4/2002 Tsuchida
6,826,836 B1 12/2004 Lin
7,587,827 B2 * 9/2009 Scheiter ..... B26B 29/025 224/232
8,117,754 B2 2/2012 Lion et al.
8,887,971 B2 * 11/2014 Hou ..... A45F 5/14 224/232
9,451,821 B1 * 9/2016 Estigoy ..... A45F 5/021
9,770,837 B2 * 9/2017 Heine ..... A45F 5/021

* cited by examiner

*Primary Examiner* — Bryon P Gehman
(74) *Attorney, Agent, or Firm* — Law Office of Vadim Rodin

(57) ABSTRACT

A knife guard having a multi-step locking mechanism is disclosed. Specifically, a knife guard comprising an elongated sheath, a first fastener, and a first movable flap is disclosed. The elongated sheath defines a first cavity for a knife blade and has a first opening in communication with the first cavity. The first fastener is secured to the sheath body. The first movable flap extends from the sheath body and is movable over the first opening for partially covering the first opening. The first movable flap has a distal end connectable to the first fastener for forming a multi-step lock.

20 Claims, 3 Drawing Sheets

CHILD PROOF KNIFE GUARD

The present invention relates generally to a knife guard and, more specifically, to a knife guard having a child proof lock.

BACKGROUND OF THE INVENTION

There are a wide variety of cutlery, i.e., knives, which range in size, shape and purpose. However, knives can generally be categorized under two forms: knives that have a fixed blade and knives that have foldable or otherwise removable blade. Regardless of the type of knife, the common element among all knives is a bladed, i.e. sharp, edge capable of cutting through materials. Consequently, while the bladed edge of a knife is present, the knife creates a clear and present danger to the user of the knife and to those around him. This danger is especially serious when an inexperienced user, such as a child, wields the knife.

Additionally, a knife is only as useful as the sharpness of the bladed edge. To ensure the life and effectiveness of the knife, the knife must be safely and properly stored. If improperly stored, the blade edge may dull, chip or otherwise degrade from exposure to, e.g., water, chemicals or hard surfaces. Thus, unlike a foldable knife, knives with fixed blades, such as chef knives, must be stored away in a safe container, such as a knife block. However, present day containers, such as traditional knife blocks, are easily accessible to children because they have no locking mechanism. Additionally, present day containers are typically bulky and burdensome to carry for the purposes of protecting, for example, a single knife.

Therefore, what is desired is a knife guard that is capable of safely storing a fixed blade knife, such as a chef knife, while being easily accessible to trained users and while being substantially inaccessible to untrained users, such as children. When the teachings of the disclosure herein is used in combination with traditional knives, especially those knives having a blade wider than the handle, the disclosure overcomes one or more of the disadvantages referenced above by providing a knife guard having a movable flap securable via a child proof lock to inhibit a child from removing an encased knife.

BRIEF SUMMARY OF THE INVENTION

In accordance with an exemplary embodiment of the present disclosure, there is provided a knife guard comprising an elongated sheath body, a first fastener and a first movable flap. The elongated sheath body defines a first cavity for a knife blade and has a first opening in communication with the first cavity. The first fastener is secured to the sheath body. The first movable flap extends from the sheath body and is movable over the first opening for partially covering the first opening. Additionally, the first movable flap has a distal end connectable to the first fastener for forming a multi-step lock.

An aspect of this exemplary embodiment of the present disclosure is that the sheath body defines a second cavity for a second knife blade and has a second opening in communication with the second cavity. The knife guard further comprises a second fastener secured to the sheath body and a second movable flap extending from the sheath body and movable over the second opening for partially covering the second opening, wherein the second movable flap has a distal end connectable to the second fastener for forming a multi-step lock. The second opening opens into the second cavity in a direction substantially opposite of a direction that the first opening opens into the first cavity. Alternatively, the second opening is adjacent to the first opening on the sheath body.

Another aspect of this exemplary embodiment of the present disclosure is that the first movable flap has a first side with a connector configured to fasten to the first fastener for forming the multi-step lock and a second side opposite the first side with another connector configured to fasten to a quick-release fastener for forming a quick-release lock. The knife guard further comprises a quick-release fastener on a side of the sheath body opposite the first fastener, wherein the distal end of the first movable flap is connectable to the quick-release fastener for forming a quick-release lock. The quick-release lock is one of a Velcro, a clasp or a snap. The multi-step lock is one of a child proof lock or a combination lock.

Another aspect of this exemplary embodiment of the present disclosure is that the knife guard further comprises a sharpening element in the first cavity. The elongated sheath is formed of wood. The elongated sheath is formed of cut-resistant fabric. The elongated sheath is formed of a polymer.

Other features and advantages of the present disclosure will be apparent from the following more detail description of the exemplary embodiments.

BRIEF DESCRIPTION OF THE SEVERAL VIEWS OF THE DRAWINGS

The foregoing summary, as well as the following detailed description of the exemplary embodiments of the disclosure, will be better understood when read in conjunction with the appended drawings. For the purpose of illustrating the disclosure, there are shown in the drawings exemplary embodiments. It should be understood, however, that the disclosure is not limited to the precise arrangements and instrumentalities shown.

DETAILED DESCRIPTION OF THE INVENTION

Reference will now be made in detail to the various embodiments of the present disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the present invention in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

Throughout this disclosure, various aspects of the present disclosure can be presented in a range format. It should be understood that the description in range format is merely for convenience and brevity and should not be construed as an inflexible limitation on the scope of the present invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the present disclosure may be combined in any suitable manner in one or more embodiments. One skilled in the relevant art will recognize, in light of the description herein, that the present invention can be practiced without one or more of the specific features or advantages of a particular exemplary embodiment. In other instances, additional features and advantages may be recognized in certain embodiments that may not be present in all exemplary embodiments of the present disclosure.

Figure 1:
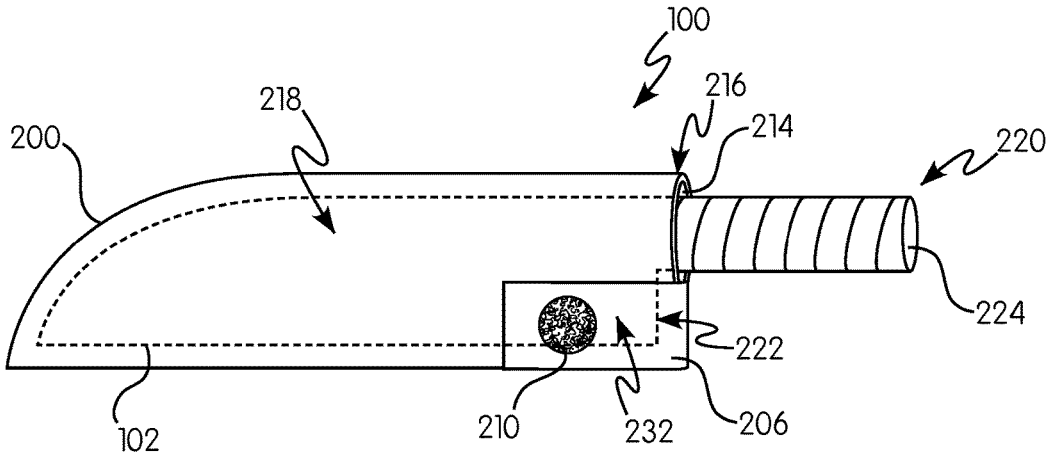
FIG. 1 is a front perspective view of a chef knife stored inside an exemplary embodiment of the present disclosure.
Figure 2A:
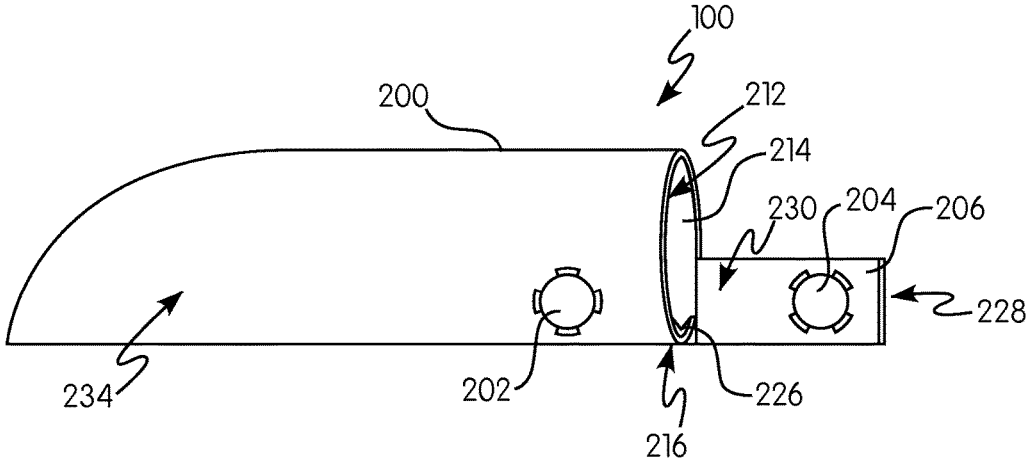
FIG. 2A is a front perspective view of a knife guard in accordance with an exemplary embodiment of the present disclosure.
Figure 2B:
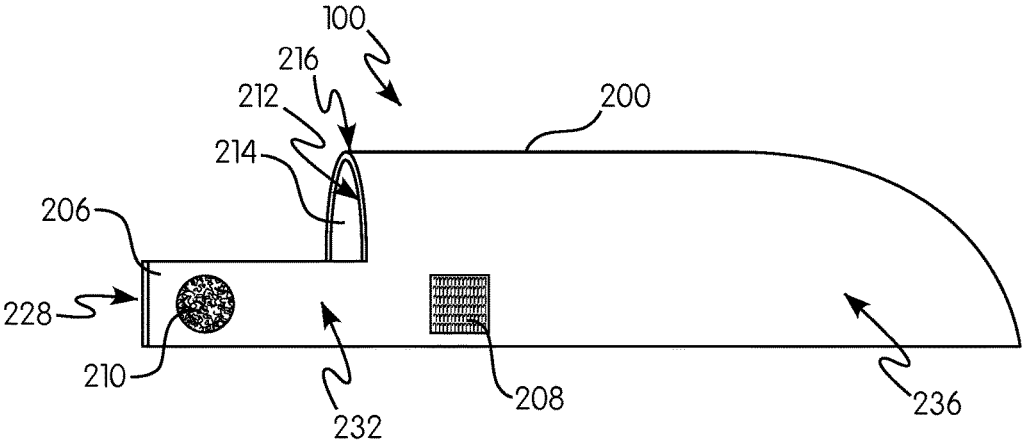
FIG. 2B is a back perspective view of the knife guard of FIG. 2A.

Referring now to the drawings, wherein aspects of the subject disclosure are shown, FIGS. 1-2B illustrate an exemplary embodiment of a child-proof knife guard 100. The child proof knife guard 100 includes an elongated sheath body 200, a first fastener 202, a first fastener connector 204, a movable flap 206, a quick-release fastener 208 and a quick-release connector 210.

The elongated sheath body 200 is configured substantially as shown in FIGS. 1-2B. The elongated sheath body 200 is an elongated container having a first cavity 212 and defining an opening 214 leading into the first cavity 212. In the exemplary embodiment, the cavity 212 extends substantially along the majority of a longitudinal length of elongated sheath body 200. The opening 214 is preferably located at a first end 216 of the elongated sheath body 200. The first cavity 212 is sized to receive a knife blade 218 of a knife 220.

As shown in dashed lines in FIG. 1, in an exemplary embodiment, the knife 220 is shaped to have a downwardly extending portion 222 which extends past the handle 224. Such knives 220 include chef's knives, utility knives, paring knives, bread knives, santoku knives, slicing/carving knives, meat cleavers, vegetable cleavers, nakiri knives, honesuki knives, tomato knives, and so forth. It is appreciated that any knives or bladed instruments having a downwardly extending portion 222 can also be utilized with the present disclosure.

In other words, the knife guard 100 comprises an elongated sheath body 200 defining a first cavity 212 for a knife blade 218 and having a first opening 214 in communication with the first cavity 212. The elongated sheath body 200 can be made of any suitable material or combination of materials capable of safely housing the knife 220. Such materials includes wood, metal, cut-resistant fabrics, e.g., leather, polymers, and so forth as is well known in the art. In other words, the elongated sheath body 200 is formed of wood, of cut-resistant fabric, and/or of a polymer.

Additionally, the elongated sheath body 200 can also include a sharpening element 226 disposed along a side of the first cavity 212, and preferably along the side that will contact a bladed edge 102 of the knife blade 218. The sharpening element 226 is configured to sharpen the bladed edge 102 as the knife blade 218 is moved along a length of the first cavity 212. The sharpening element 226 can be made of stone, metal, sand paper, ceramic, diamond-ceramic, and so forth as is well known in the art. Alternatively, and/or in addition to, the sharpening element 226 may instead be a polishing or cleaning element made of, e.g., fabric configured to polish or clean the bladed edge 102. Such polishing or cleaning elements are well known in the art. In other words, the knife guard 100 further comprises a sharpening element 226 in the first cavity 212. It is appreciated that the sharpening element 226 can be integrally formed with the elongated sheath 200 or may be removably attachable to the opening 214 in ways known in the art.

As shown in FIGS. 2A-2B, the elongated sheath body 200 has a movable flap 206 which extends from the first end 216. The movable flap 206 is configured to be pivotable about the first end 216 for partially covering the opening 214. In an exemplary embodiment, the movable flap 206 has a length long enough to extend past the first end 216 towards a remainder of the elongated sheath body 200. As shown in FIG. 1, in an exemplary embodiment, the movable flap 206 is sized to only partially cover the opening 214 such that the handle 224 of the knife 220 can stick out of the elongated sheath body 200 while the downwardly extending portion 222 is secured by the movable flap 206. As such, the movable flap 206 is preferably made of cut resistant fabric, e.g., leather, such that it can be flexed and moved about the first end 216. Additionally, in the exemplary embodiment, the movable flap 206 and the elongated sheath body 200 are integrally formed with each other, however, it is appreciated that the movable flap 206 can be pivotably attached to the first end 216 via, e.g., a hinge. Therefore, the movable flap 206 can be made of the same materials as the elongated sheath body 200 or a combination of materials similar to the elongated sheath body 200.

Additionally, the movable flap 206 has a distal end 228 which has, at or about the distal end 228, one or more connecting elements configured to secure to a fastener on a side of the elongated sheath body 200. A first side 230 of the movable flap 206, i.e., the side that faces towards the opening 214, includes the first fastener connector 204 which is configured to form a multi-step lock with the first fastener 202. A second side 232, opposite the first side 230, of the movable flap 206, i.e., the side that faces away from the opening 214, includes the quick-release connector 210 which is configured to form a quick-release lock with the quick-release fastener 208. It is appreciated that the first fastener connector 204 and/or the quick-release connector 210 can positioned anywhere along the movable flap 206, such as at the distal end 228, near an edge of the movable flap 206, centrally to the sides of the movable flap 206, and so forth. However, it is also appreciated that the connectors 204, 210 can extend outwardly from the distal end 228 of the movable flap 206, such as for example via hooks.

In an exemplary embodiment, the first fastener 202 is configured to form a multi-step lock with the first fastener connector 204 and is secured to a first side 234 of the elongated sheath body 200. Specifically, the first fastener 202 is located at or about a position of the elongated sheath body 200 such that the movable flap 206 can be pivoted about the first end 216 and over the opening 214 and be connected to the first fastener 202. In an exemplary embodiment, the first fastener 202 is integrally formed with the elongated sheath body 202. However, it is appreciated that the first fastener 202 can be separately attached the elongated sheath body 200 via, e.g., a clasp, a screw, and so forth in ways known in the art.

The first fastener 202 is configured to be engaged by the first fastener connector 204 to thereby form a multi-step lock. The multi-step lock is a lock that requires specific tools or multiple steps to open, thereby increasing the difficulty of opening the lock to make it more "child-proof." Such multi-step locks include magnetic locks requiring magnetic keys, clasps, combinations locks, cord locks, sliding locks, spring release locks/latches, press/twist locks (e.g. pill bottles), hook-and-eye clasps, and so forth as is well known in the art. Such locks are considered multi-step locks because they require two or more different actions to open. For example, as shown in FIG. 2A, the depicting locking mechanism is a press/twist lock that requires a user to depress and simultaneously rotate the first fastener connector 204 to release the movable flap 206 from the first fastener 202. Thus, in an exemplary embodiment, the first fastener 202 includes a first part of the multi-step lock, e.g., a circular member with teeth extending outwardly, and the first fastener connector 204 includes a second part of the multi-step lock, e.g., a rotatable circular member with teeth extending outwardly configured to interlock with the teeth of the first part of the multi-step lock when rotated.

In an exemplary embodiment, the quick-release fastener 208 is secured to a second side 236 of the elongated sheath body 200, opposite the first side 234. Specifically, the quick-release fastener 208 is located at or about a position of the elongated sheath body 200 such that the movable flap 206 can be pivoted about the first end 216 and away from the opening 214 and be connected to the quick-release fastener 208. In an exemplary embodiment, the quick-release fastener 202 is integrally formed with the elongated sheath body 202.

The quick-release fastener 208 is configured to be engaged by the quick release connector 210 to thereby form a quick-release lock. The quick-release lock is a lock that can be simply and quickly released such as, for example, requiring only an application of force, preferably, a single direction to disengage the quick-release connector 210 from the quick-release fastener 208. Such quick-release locks include hook and loop fasteners, snaps, clasps, magnets and so forth as is well known in the art. Thus, in an exemplary embodiment, the quick-release fastener 208 includes a first part of the quick-release lock, e.g., a series of hooks, and the quick-release connector 210 includes a second part of the quick-release lock, e.g., a series of loops.

In other words, the knife guard 100 comprises a first fastener 202 secured to the sheath body 200 and a first movable flap 206 extending from the sheath body 200 and movable over the first opening 214, wherein the first movable flap 206 has a distal end 228 connectable to the first fastener 202 for forming a multi-step lock. The first movable flap 206 has a first side 230 that has a connector, i.e., a first fastener connector 204, configured to fasten to the first fastener 202 for forming the multi-step lock and a second side 232 opposite the first side 230 that has another connector, i.e., a quick-release connector 210, for forming a quick-release lock.

Further, the knife guard 100 comprises a quick-release fastener 208 on a side of the sheath body 200 opposite the first fastener 202, i.e., the second side 236, wherein the distal end 228 of the first movable flap 206 is connectable to the quick-release fastener 208 for forming a quick-release lock. The quick-release lock is one of a hook and loop fastener, a clasp or a snap. The multi-step lock is one of a child proof lock or a combination lock.

It is appreciated that, for purposes of either the multi-step lock or the quick-release lock, the knife guard 100 can include additional straps or features configured to facilitate the function of the multi-step lock and/or quick-release lock. For example, the multi-step lock can be formed with multiple overlapping quick-release locks, such as Velcro or snaps, requiring transverse applications of force to release, thereby forming a multi-step locking. Such modifications are well known in the art and do not necessitate additional discussion for the purposes of the present invention. Additionally, it is also appreciated that the connectors 204, 210 can be independent components attached to the movable flap 206 or may be a single piece having different locking mechanisms on opposite sides.

Referring now to FIGS. 1-2B, the knife guard 100 is configured substantially as shown. Specifically, the elongated body 200 includes the first opening 214 which leads into the first cavity 212 circumscribed by the elongated sheath body 200. A first fastener 202 is secured and/or integrally formed on the first side 234 of the elongated sheath body 200 and a quick-release fastener 208 is secured and/or integrally formed on the second side 236 of the elongated sheath body 200. The movable flap 206 extends from the first end 216 of the elongated sheath body 200 and is pivotable about the first end 216 to secure to either the first fastener 202 or the quick-release fastener 208 via the first fastener connector 204 or the quick-release connector 210 to form a multi-step lock or a quick-release lock, respectively. Further, the first cavity 212 is sized and shaped to receive the knife blade 218 and the movable flap 206 is sized to partially cover the first opening 214 and engage the downwardly extending portion 222 of the knife 220. The first cavity 212 additionally includes a sharpening element 226 extending within the first cavity 212 and/or adjacent to the first opening 214.

Accordingly, when a knife 220 is inserted into the first cavity 212 through the first opening 214, a user of the knife can lock the knife 220 in place by moving the movable flap 206 over the downwardly extending portion 222 and towards the first fastener 202. The user can then utilize the first fastener 202 and the first connector 204 to lock the knife 220 inside the cavity. Because the first fastener 202 and the first connector 204 form a multi-step lock, the user will need to execute multiple steps to remove the knife 220. Alternatively, the user can store the knife 220 in the cavity 212 and secure the movable flap 206 to the quick-release fastener 208 for enabling ease of access/removal of the knife 220.

The advantages of having a knife guard with a multi-step lock are apparent. For example, if a knife is left unattended and easily accessible, an inexperienced user, such as a child, can expose himself or others to danger. However, if the knife is secured in a multi-step lock, then the inexperienced user, such as a child, will not be able to remove the knife and thereby significantly reduce the risk of harm to himself or others. Additionally, the present invention allows the user to safely transport the knife without risk of the knife falling out of the guard. Therefore, accidental damage to the knife during transportation can be avoided.

Figure 3A:
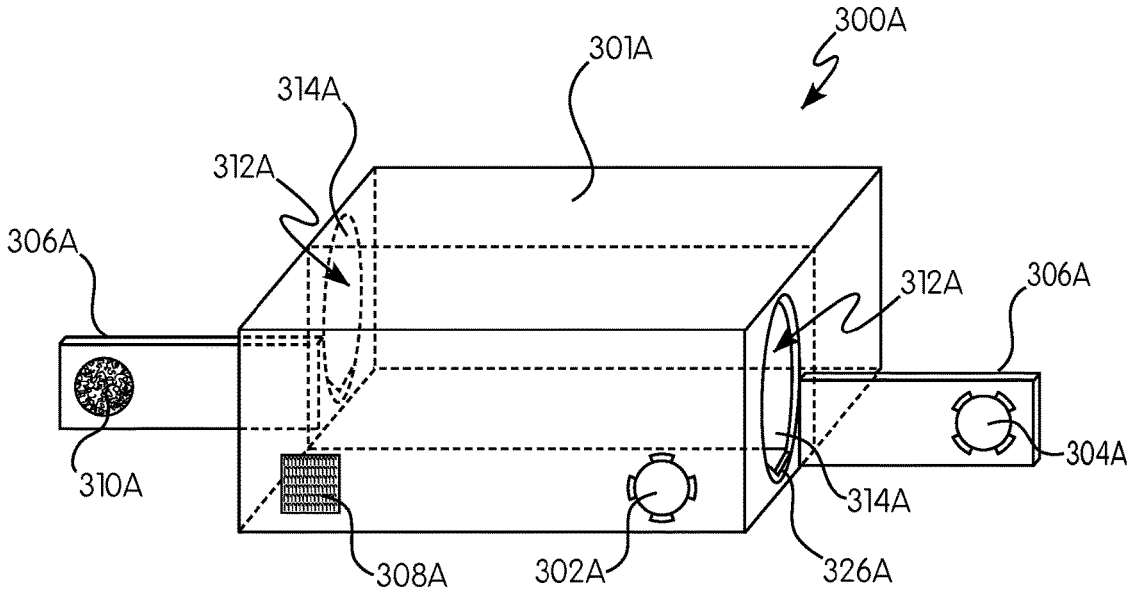
FIG. 3A is a perspective view of a knife guard in accordance with another exemplary embodiment of the present disclosure.
Figure 3B:
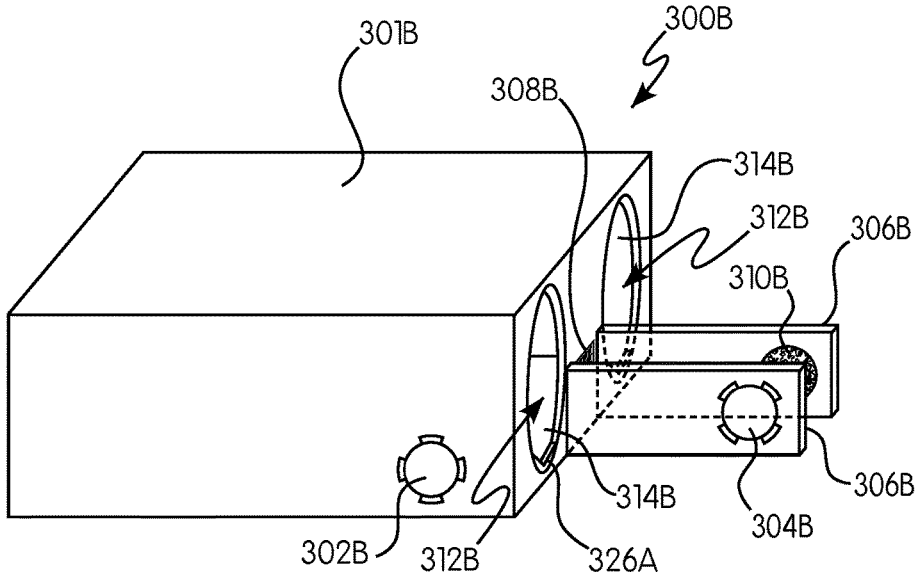
FIG. 3B is a perspective view of a knife guard in accordance with another exemplary embodiment of the present disclosure.
Figure 4:
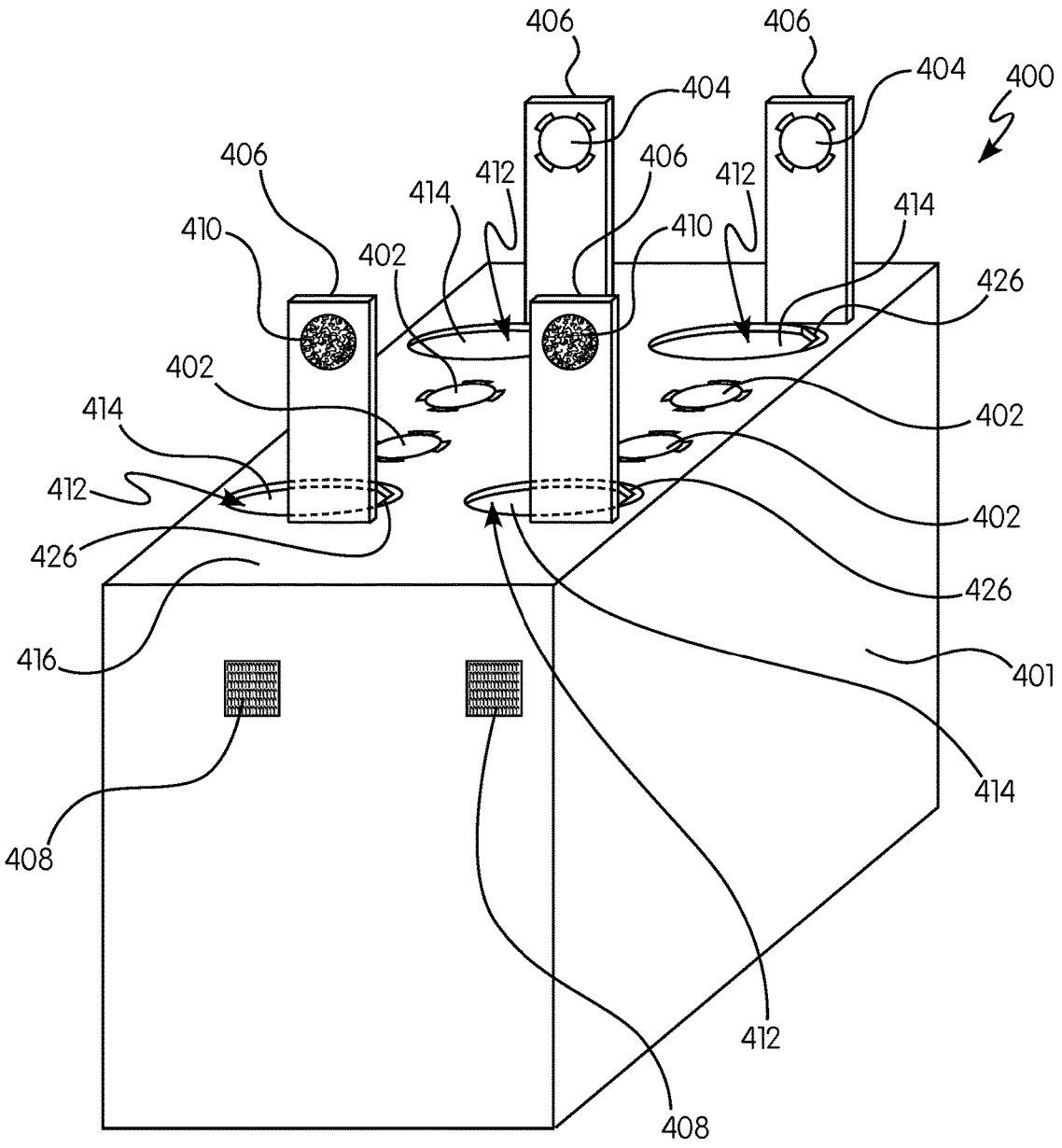
FIG. 4 is a perspective view of a knife guard in accordance with another exemplary embodiment of the present disclosure.

Referring now to FIGS. 3A-4, alternate embodiments of the present invention are shown. Specifically, FIGS. 3A-4 show knife guards 300A, 300B, 400 each having an elongated sheath body 301A, 301 B, 401, a plurality of first fasteners 302A, 302B, 402, a plurality of first fastener connectors 304A, 304B, 404, a plurality of movable flaps 306A, 306B, 406, a plurality of quick-release fasteners 308A, 308B, 408 and a plurality of quick-release connectors 310A, 310B, 410.

It is appreciated that, for convenience purposes only, not every first fastener, first fastener connector, quick-release fastener and quick-release connector is shown only as a result of the orientations of the views in FIGS. 3A-4. Therefore, it is also appreciated that the teachings of the knife guard 100 are equally applicable to the alternate embodiments of the knife guards 300A, 300B, 400, including the positioning of the remainder of the first fasteners, first fastener connectors, quick-release fasteners and quick-release connectors relative to the knife guard 100, 300A, 300B, 400.

In addition to the structure described above, the elongated sheath bodies 301A, 301B, 401 include additional openings and cavities configured substantially as shown in FIGS. 3A-4 that are similar to the opening 214 and cavity 212 of the elongated sheath body 200. With respect to FIG. 3A, the elongated sheath body 301A includes two openings 314A located at opposite ends of the elongated sheath body 301A. With respect to FIG. 3B, the elongated sheath body 301 B includes two openings 314B adjacent to each other. Similarly, with respect to FIG. 4, the elongated sheath body 401 includes a plurality of openings 414 interspersed across a face 416 of the elongated sheath body 401. In an exemplary embodiment of the knife guard 400, the elongated sheath body 401 is a knife block.

It is appreciated that the openings 314A, 314B, 414 lead into independent cavities 312A, 312B, 412. In an exemplary embodiment, the cavities 312A, 312B, 412 do not intersect one another but are adjacent to one another. However, it is appreciated that the cavities 312A, 312B, 412 can overlap or interconnect. Additionally, the cavities 312A, 312B, 412 can include a sharpening, polishing, and/or cleaning element 326A, 326B, 426 similar to the sharpening element 226 described above.

In other words, the knife guard 300A, 300B, 400 has a sheath body 301A, 301B, 401 that defines a second cavity 312A, 312B, 412 for a second knife blade and has a second opening 314A, 314B, 414 in communication with the second cavity, and further comprises a second fastener 302A, 302B, 402 secured to the sheath body, and a second movable flap 306A, 306B, 406 extending from the sheath body and movable over the second opening for partially covering the second opening, wherein the second movable flap has a distal end connectable to the second fastener for forming a multi-step lock. The second opening 314A, 314B, 414 opens into the second cavity 312A, 312B, 412 in a direction substantially opposite of a direction that the first opening 314A, 314B, 414 opens into the first cavity 312A, 312B, 412. Alternatively, the second opening 314A, 314B, 414 is adjacent to the first opening 314A, 314B, 414 on the sheath body 301A, 301B, 401.

While the present invention has been described with reference to exemplary embodiments, it will be appreciated by those skilled in the art that various changes may be made and equivalents may be substituted for elements thereof without departing from the scope of the present invention. For example, features described in one embodiment may be incorporated into a different embodiment. Additionally, features described in one manner may instead be accomplished by known techniques in the art.

In addition, modifications may be made to adapt a particular situation or material to the teachings of the present invention without departing from the essential scope thereof. For example, the knife guard can include multiple locking mechanisms, either a multi-step or quick-release, for securing to other components or members such as walls. It is to be understood, therefore, that the present invention not be limited to the particular aspects disclosed, but it is intended to cover modifications within the spirit and scope of the present invention as defined by the appended claims.

I claim:

1. A knife guard comprising:

an elongated sheath body defining a first cavity for a knife blade and having a first opening in communication with the first cavity; and a lock having:

a first fastener secured to the sheath body, and a first movable flap extending from the sheath body and movable over the first opening for partially covering the first opening, wherein the first movable flap has a distal end connectable to the first fastener for forming the lock, and wherein when the distal end of the first movable flap is connected to the first fastener, the distal end of the first movable flap is releasable from the first fastener by an application of at least two or more different actions performed on the first fastener.

2. The knife guard of claim 1, wherein the sheath body defines a second cavity for a second knife blade and has a second opening in communication with the second cavity, further comprising a second lock having:

a second fastener secured to the sheath body; and a second movable flap extending from the sheath body and movable over the second opening for partially covering the second opening, wherein the second movable flap has a distal end connectable to the second fastener for forming the second lock.

3. The knife guard of claim 2, wherein the second opening opens into the second cavity in a direction substantially opposite of a direction that the first opening opens into the first cavity.

4. The knife guard of claim 2, wherein the second opening is adjacent to the first opening on the sheath body.

5. The knife guard of claim 1, further comprising a quick-release lock, wherein the first movable flap has a first side with a connector configured to fasten to the first fastener for forming the lock and a second side opposite the first side with another connector configured to fasten to a quick-release fastener for forming the quick-release lock.

6. The knife guard of claim 5, wherein the quick-release fastener is secured to a side of the sheath body opposite the first fastener.

7. The knife guard of claim 5, wherein the quick-release lock is one of a hook and loop fastener, a clasp and a snap.

8. The knife guard of claim 1, wherein the lock is a combination lock.

9. The knife guard of claim 1, further comprising a sharpening element in the first cavity.

10. The knife guard of claim 1, wherein the elongated sheath is formed of wood.

11. The knife guard of claim 1, wherein the elongated sheath is formed of cut-resistant fabric.

12. The knife guard of claim 1, wherein the elongated sheath is formed of a polymer.

13. A knife guard comprising:

an elongated sheath body defining a first cavity for a knife blade and having a first opening in communication with the first cavity;

a combination lock secured to the sheath body; and a first movable flap extending from the sheath body and movable over the first opening for partially covering the first opening, wherein the first movable flap has a distal end connectable to the combination lock, and wherein when the distal end of the first movable flap is connected to the combination lock, the distal end of the first movable flap is releasable from the combination lock by operating the combination lock.

14. The knife guard of claim 13, further comprising a quick-release lock, wherein the first movable flap has a first side with a connector configured to fasten to the combination lock and a second side opposite the first side with another connector configured to fasten to a quick-release fastener for forming the quick-release lock.

15. The knife guard of claim 14, wherein the quick-release fastener is secured to a side of the sheath body opposite the combination lock.

16. The knife guard of claim 14, wherein the quick-release lock is one of a hook and loop fastener, a clasp and a snap.

17. A knife guard comprising:

an elongated sheath body defining a first cavity for a knife blade and having a first opening in communication with the first cavity; and a lock having:

a first fastener secured to the sheath body, and a first movable flap extending from the sheath body and movable over the first opening for partially covering the first opening, wherein the first movable flap has a distal end connectable to the first fastener for forming the lock, and wherein when the distal end of the first movable flap is connected to the first fastener, the distal end of the first movable flap is releasable from the first fastener by an application of at least two or more different actions performed on the distal end of the first movable flap.

18. The knife guard of claim 17, wherein the lock includes:

a circular member with outwardly extending teeth carried by the first fastener, and a rotatable circular member with outwardly extending teeth carried by the first movable flap, wherein the teeth of the circular member and the teeth of the rotatable circular member interlock and release from interlocking upon depression of the rotatable circular member and rotation of the rotatable circular member relative to the circular member.

19. The knife guard of claim 17, further comprising a quick-release lock, wherein the first movable flap has a first side with a connector configured to fasten to the first fastener for forming the lock and a second side opposite the first side with another connector configured to fasten to a quick-release fastener for forming the quick-release lock.

20. The knife guard of claim 19, wherein the quick-release lock is one of a hook and loop fastener, a clasp and a snap.

* * * * *